US009113732B2

(12) United States Patent
Loth

(10) Patent No.: US 9,113,732 B2
(45) Date of Patent: Aug. 25, 2015

(54) SYSTEM AND METHOD FOR AN ADJUSTABLE CERVICAL CONTOUR PILLOW

(71) Applicant: Jason Loth, Mesa, AZ (US)

(72) Inventor: Jason Loth, Mesa, AZ (US)

(73) Assignee: Pro 356 LLC, Gilbert, AZ (US)

( * ) Notice: Subject to any disclaimer, the term of this patent is extended or adjusted under 35 U.S.C. 154(b) by 0 days.

(21) Appl. No.: 13/865,169

(22) Filed: Apr. 17, 2013

(65) Prior Publication Data

US 2014/0020184 A1 Jan. 23, 2014

Related U.S. Application Data

(60) Provisional application No. 61/674,291, filed on Jul. 20, 2012.

(51) Int. Cl.
*A47G 9/10* (2006.01)

(52) U.S. Cl.
CPC ..... *A47G 9/1081* (2013.01); *A47G 9/109* (2013.01)

(58) Field of Classification Search
CPC ..... A47G 9/10; A47G 9/1081; A47G 9/109; A47G 2009/10; A47G 2009/1081
USPC ..... 5/636, 637, 639, 640, 644, 645; D6/601
See application file for complete search history.

(56) References Cited

U.S. PATENT DOCUMENTS

| | | | | | |
|---|---|---|---|---|---|
| 4,829,614 | A | | 5/1989 | Harper | |
| 5,038,432 | A | * | 8/1991 | Robillard et al. | 5/645 |
| D328,682 | S | * | 8/1992 | Carney | D6/601 |
| 5,471,691 | A | | 12/1995 | Ryndak | |
| D376,288 | S | * | 12/1996 | Antonian | D6/601 |
| 5,644,810 | A | | 7/1997 | Kato | |
| D402,150 | S | * | 12/1998 | Wurmbrand et al. | D6/601 |
| 6,079,066 | A | * | 6/2000 | Backlund | 5/636 |
| 6,363,557 | B2 | * | 4/2002 | Chou | 5/645 |
| 6,671,906 | B1 | * | 1/2004 | Milligan | 5/636 |
| 6,931,682 | B2 | | 8/2005 | Kruger, Jr. | |
| 6,981,288 | B1 | * | 1/2006 | Hu | 5/636 |
| 7,669,265 | B2 | * | 3/2010 | Weise | 5/640 |
| 7,788,750 | B2 | | 9/2010 | Norstream | |
| 2006/0031996 | A1 | * | 2/2006 | Rawls-Meehan | 5/724 |
| 2008/0134438 | A1 | * | 6/2008 | Park | 5/636 |

* cited by examiner

*Primary Examiner* — Nicholas Polito

(74) *Attorney, Agent, or Firm* — Lisa Foundation Patent Law Clinic at Arizona State University

(57) ABSTRACT

The present invention comprises methods and systems for an adjustable cervical contour pillow. The pillow comprises a left, right and center compartment with a generally concave anterior face comprising a first curvature and a second curvature and a web there between configured such that the height of the first curvature is greater than the height of the web but lower than the height of the second curvature. The pillow comprises a generally flat posterior face. The center compartment may be further configured such that the height of each of the first curvature, the web and the second curvature of the center compartment are less than the corresponding heights of the analogous portions of the left and right compartments. The compartments may be covered in a material that is comprised of cotton. The pillow may be filled with a blend of different sizes of shredded latex.

19 Claims, 6 Drawing Sheets

SYSTEM AND METHOD FOR AN ADJUSTABLE CERVICAL CONTOUR PILLOW

CROSS REFERENCE TO RELATED APPLICATION

This application claims priority to Provisional Patent Application No. 61,674,291, filed Jul. 20, 2012, entitled "An Adjustable Cervical Contour Pillow."

BACKGROUND OF THE INVENTION

1. Field of the Invention

This application relates to pillows for sleeping generally and to cervical contour pillows specifically.

2. Description of Related Art

Many prior patents exist for pillows which attempt to help a user maintain proper posture while sleeping. Some have multiple compartments. Some are adjustable.

One example of a manner in which a pillow has been made adjustable is U.S. Pat. No. 4,829,614 to Harper (hereinafter "Harper") which teaches laterally extending chambers, inflatable with air.

Another example is U.S. Pat. No. 7,788,750 issued to Norstream. (hereinafter "Norstream") which teaches a Cervical Contour Pillow with two cells integrated at their periphery and a fluid fillable insert.

Another example is U.S. Pat. No. 6,931,682 issued to Kruger, Jr. (hereinafter "Kruger") which teaches a pillow with a periphery filled to a greater height than a center section.

Another example is U.S. Pat. No. 5,471,691 issued to Ryndak (hereinafter "Ryndak") which teaches an elongated pillow with multiple tiers at varying heights.

A further example is U.S. Pat. No. 5,644,810 issued to Kato (hereinafter "Kato") which teaches a pillow having opposed horizontal side head end support units and a central head back support unit there between comprising vertically opposed neck-bones' support sections separated by an overall central head back rest section. The respective units and sections are segregated into attached, compartmentalized areas where the head back support unit is lower than the horizontal end support units, and the head back rest section is lower than the vertically opposed neck-bones' support sections.

So as to reduce the complexity and length of the Detailed Specification, and to fully establish the state of the art in certain areas of technology, Applicant(s) herein expressly incorporate(s) by reference all of the following materials identified in each numbered paragraph below.

U.S. Pat. No. 4,829,614
U.S. Pat. No. 7,788,750
U.S. Pat. No. 6,931,682
U.S. Pat. No. 5,644,810
U.S. Pat. No. 5,471,691

Applicant(s) believe(s) that the material incorporated above is "non-essential" in accordance with 37 CFR 1.57, because it is referred to for purposes of indicating the background of the invention or illustrating the state of the art. However, if the Examiner believes that any of the above-incorporated material constitutes "essential material" within the meaning of 37 CFR 1.57(c)(1)-(3), applicant(s) will amend the specification to expressly recite the essential material that is incorporated by reference as allowed by the applicable rules.

BRIEF SUMMARY OF THE INVENTION

The present invention comprises among other things novel methods and systems for an adjustable cervical contour pillow to support a person in correct posture regardless of whether they are resting in the supine or side lying position. The apparatus has two sides with different sizes and is adjustable to accommodate different sized individuals This invention relates to a cervical contour pillow which allows people to achieve correct head, neck and upper back posture while sleeping in either the supine or side lying position. Most current cervical contour pillows do not allow correct orthopedic posture for differently sized people. Rather a different sized pillow is required for different sized persons. Most current cervical contour pillows cannot be customized. While some current cervical contour pillows offer correct posture for one position, supine or side lying, they rarely offer it for both, especially being able to fit people of different sizes. Some implementations of the claimed invention have two sides with different sizes and is adjustable to accommodate different sized individuals. The claimed invention solves these shortcomings of the current art of contour cervical contour pillows.

Implementations of a pillow may comprise an adjustable cervical contour pillow comprising a left compartment coupled to a center compartment and a right compartment. The center compartment may be coupled to the left compartment and the right compartment and located between the left and right compartments. Each of the left, the right, and the center compartments may further comprise a mechanical closure configured to receive addition or removal of fill. A first curvature, a web, and a second curvature may be configured such that a height of the first curvature is greater than a height of the web but lower than a height of the second curvature. The center compartment may be further configured such that the height of each of the first curvature, the web and the second curvature of the center compartment are less than the corresponding heights of the analogous portions of the left and right compartments. The compartments may be fluidly independent such that fill material placed in a given compartment cannot travel to the other compartments.

Particular aspects may comprise one or more of the following features. A filled height of the first curvatures of the left and right compartments may be between 6.0 and 6.5 inches. A filled height of the second curvatures of the left and right compartments may be between 6.5 and 7.0 inches. A filled height of the web of the left and right compartments may be between 5.25 and 5.75 inches. A filled height of the first curvature of the center compartment may be between 5.25 inches and 4.75 inches. A filled height of the second curvature of the center compartment may be between 6 inches and 5.5 inches. A filled height of the web of the center compartment may be between 1.25 inches and 0.75 inches. The fill material may be shredded latex. The compartments may be covered with a material that is comprised of a bamboo-cotton blend. The compartments may be covered with a material that is comprised of cotton.

Aspects and applications of the invention presented here are described below in the drawings and detailed description of the invention. Unless specifically noted, it is intended that the words and phrases in the specification and the claims be given their plain, ordinary, and accustomed meaning to those of ordinary skill in the applicable arts. The inventor is fully aware that he can be his own lexicographers if desired. The inventor expressly elects, as his own lexicographer, to use only the plain and ordinary meaning of terms in the specification and claims unless he clearly states otherwise and then further, expressly sets forth the "special" definition of that term and explain how it differs from the plain and ordinary meaning. Absent such clear statements of intent to apply a "special" definition, it is the inventor's intent desire that the simple, plain and ordinary meaning to the terms be applied to the interpretation of the specification and claims.

The inventor is also aware of the normal precepts of English grammar. Thus, if a noun, term, or phrase is intended to be further characterized, specified, or narrowed in some way, then such noun, term, or phrase will expressly include additional adjectives, descriptive terms, or other modifiers in accordance with the normal precepts of English grammar. Absent the use of such adjectives, descriptive terms, or modifiers, it is the intent that such nouns, terms, or phrases be given their plain, and ordinary English meaning to those skilled in the applicable arts as set forth above.

Further, the inventor is fully informed of the standards and application of the special provisions of 35 U.S.C. §112, ¶ 6. Thus, the use of the words "function," "means" or "step" in the Detailed Description or Description of the Drawings or claims is not intended to somehow indicate a desire to invoke the special provisions of 35 U.S.C. §112, ¶ 6, to define the invention. To the contrary, if the provisions of 35 U.S.C. §112, ¶ 6 are sought to be invoked to define the inventions, the claims will specifically and expressly state the exact phrases "means for" or "step for, and will also recite the word "function" (i.e., will state "means for performing the function of [insert function]"), without also reciting in such phrases any structure, material or act in support of the function. Thus, even when the claims recite a "means for performing the function of . . . " or "step for performing the function of . . . ," if the claims also recite any structure, material or acts in support of that means or step, or that perform the recited function, then it is the clear intention of the inventor not to invoke the provisions of 35 U.S.C. §112, ¶ 6. Moreover, even if the provisions of 35 U.S.C. §112, ¶ 6 are invoked to define the claimed inventions, it is intended that the inventions not be limited only to the specific structure, material or acts that are described in the preferred embodiments, but in addition, include any and all structures, materials or acts that perform the claimed function as described in alternative embodiments or forms of the invention, or that are well known present or later-developed, equivalent structures, material or acts for performing the claimed function.

BRIEF DESCRIPTION OF THE SEVERAL VIEWS OF THE DRAWINGS

A more complete understanding of the present invention may be derived by referring to the detailed description when considered in connection with the following illustrative figures. In the figures, like reference numbers refer to like elements or acts throughout the figures.

Elements and acts in the figures are illustrated for simplicity and have not necessarily been rendered according to any particular sequence or embodiment.

DETAILED DESCRIPTION OF THE INVENTION

In the following description, and for the purposes of explanation, numerous specific details are set forth in order to provide a thorough understanding of the various aspects of the invention. It will be understood, however, by those skilled in the relevant arts, that the present invention may be practiced without these specific details. In other instances, known structures and devices are shown or discussed more generally in order to avoid obscuring the invention. In many cases, a description of the operation is sufficient to enable one to implement the various forms of the invention. It should be noted that there are many different and alternative configurations, devices and technologies to which the disclosed inventions may be applied. The full scope of the inventions is not limited to the examples that are described below.

Figure 1:
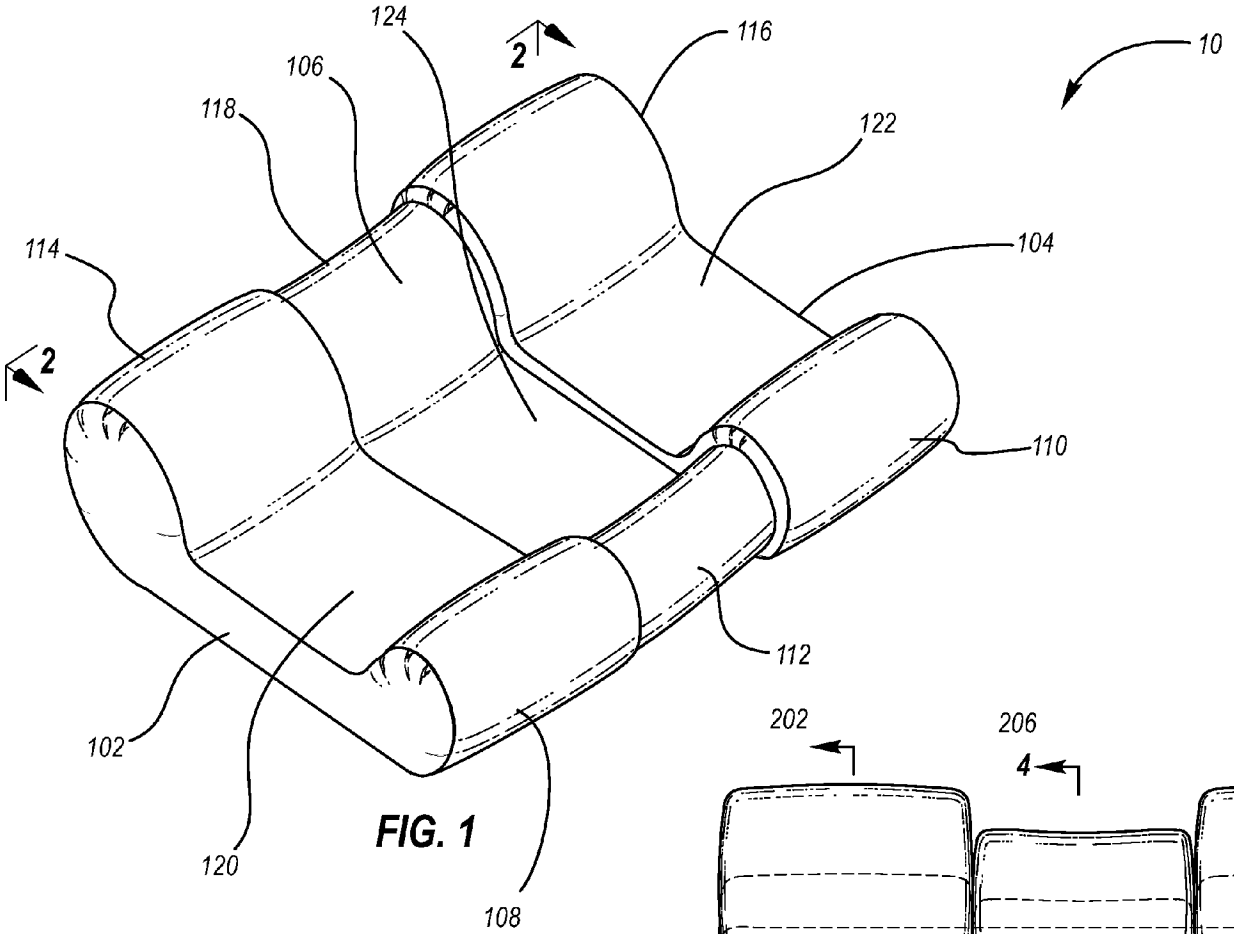
FIG. 1 depicts a perspective view of the anterior face and front left side of an implementation of an adjustable cervical contour pillow.

FIG. 1 depicts one embodiment of the invention 10, in which the apparatus comprises three discrete compartments 102, 104, and 106 with anterior and posterior faces. Some embodiments may comprise more than three compartments. The left 102 and right 104 compartments have a generally concave anterior face with a first curvature, 108 and 110 respectively, of a height which is adjustable by varying the amount of fill. In one embodiment, the filled height of the first curvature 108 and 110 may be between 6.5 to 7.0 inches. The left 102 and right 104 compartments also have a second curvature, 114 and 116 respectively, with a height which is adjustable by varying the amount of fill material. In one embodiment, the filled height of the second curvature 114 and 116 may be between 6.0 to 6.5 inches. The left 102 and right 104 compartments also have a web, 120 and 122 respectively, between the first 108, 110 and second 114, 116 curvatures with a height which is adjustable by varying the amount of fill material. In one embodiment, the filled height of the web 120 and 122 may be between 5.25 and 5.75 inches in height, however any other suitable height may also be used. The left 102 and right 104 compartments also have a generally flat posterior face.

Between the left 102 and right 104 compartments is a center compartment 106 with a generally concave anterior face comprising a first curvature 112 or cylindrical roll with a height which is adjustable by varying the amount of fill. In one embodiment, the filled height of the first curvature 112 may be between 5.25 inches and 4.75 inches. The center compartment 106 also has a second curvature 118 or cylindrical roll with a height which is adjustable by varying the amount of fill. In one embodiment, the filled height of the second curvature 118 may be between 6 inches and 5.5 inches. The center compartment 106 also has a web 124 there between the curvatures which is adjustable by varying the amount of fill. In one embodiment, the filled height of the web 124 may be between 1.25 inches and 0.75 inches with a generally flat posterior face.

In some embodiments, the compartments 102, 104, and 106 are discrete, however, the compartments 102, 104, and 106 are mechanically coupled or directly connected to each other in seriatim. The compartments 102, 104, and 106 may be filled with a moldable and compressible material. In one embodiment, the fill material may be shredded latex, however, any other moldable and compressible material that is desired by a user may be inserted into the compartments 102, 104, and 106. In one embodiment, the compartments 102, 104, and 106 may be covered with a material that is a bamboo-cotton blend. In another embodiment, the compartments 102, 104, and 106 may be covered with a material that is comprised of 100% cotton. Those skilled in the art could reasonably conceive of many other suitable covering materials.

Figure 2:
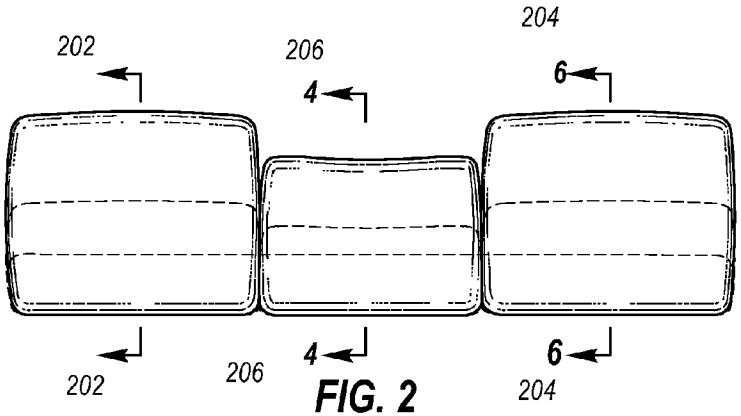
FIG. 2 depicts a rear view of an implementation of an adjustable cervical contour pillow.

FIG. 2 depicts a rear view of the second curvature 114, 116, and 118 of the compartments 102, 104, and 106. In one embodiment, the height 206 of the second curvature 118 of the center compartment 106 may be less than the height 204 of the second curvature 114 of the left compartment 102 or the height 202 of the second curvature 116 of the right compartment 104.

Figure 3:
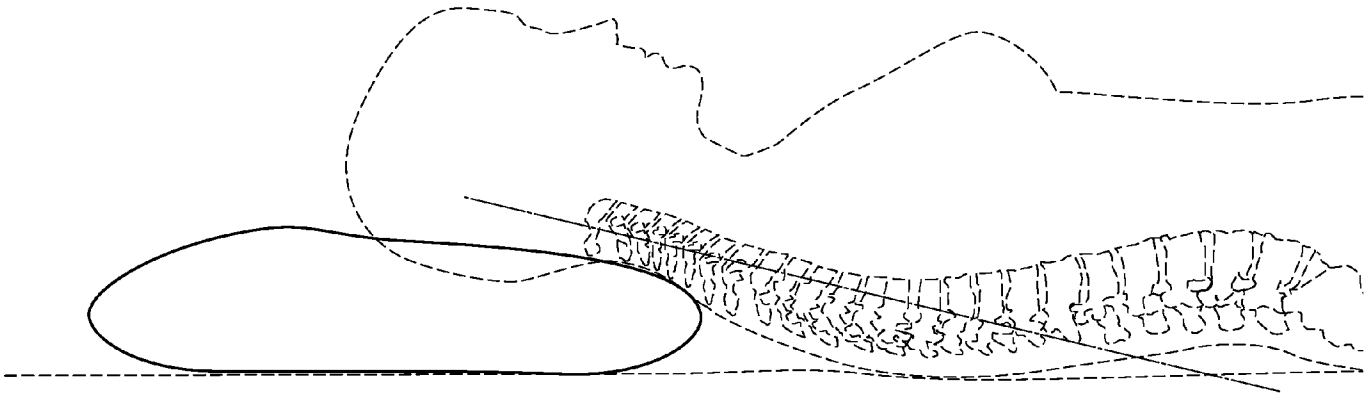
FIG. 3 (PRIOR ART)
FIG. 3 depicts a person sleeping in a supine lying position using a prior art pillow with incorrect spinal alignment.
Figure 4:
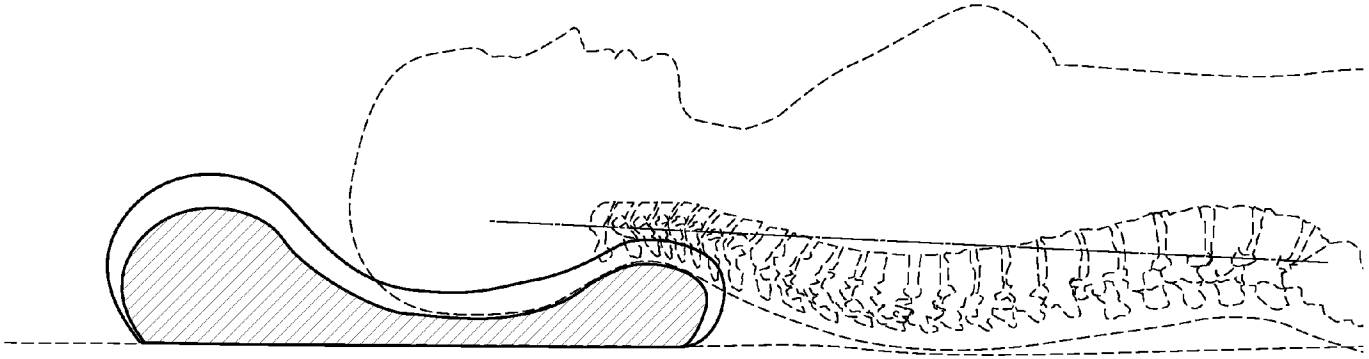
FIG. 4 depicts a side view of a person sleeping in a supine lying position using the an implementation of the present invention allowing for proper spinal alignment.

FIG. 3 and FIG. 4 depict a person lying in a supine position. In FIG. 3, the person is resting on a typical prior art pillow. The spine is shown in incorrect posture. In FIG. 4, the person is resting on the center compartment of the adjustable cervical contour pillow. FIG. 4 depicts correct supine sleeping posture after proper adjustment of the height of the curvature and web of the pillow.

Figure 5:
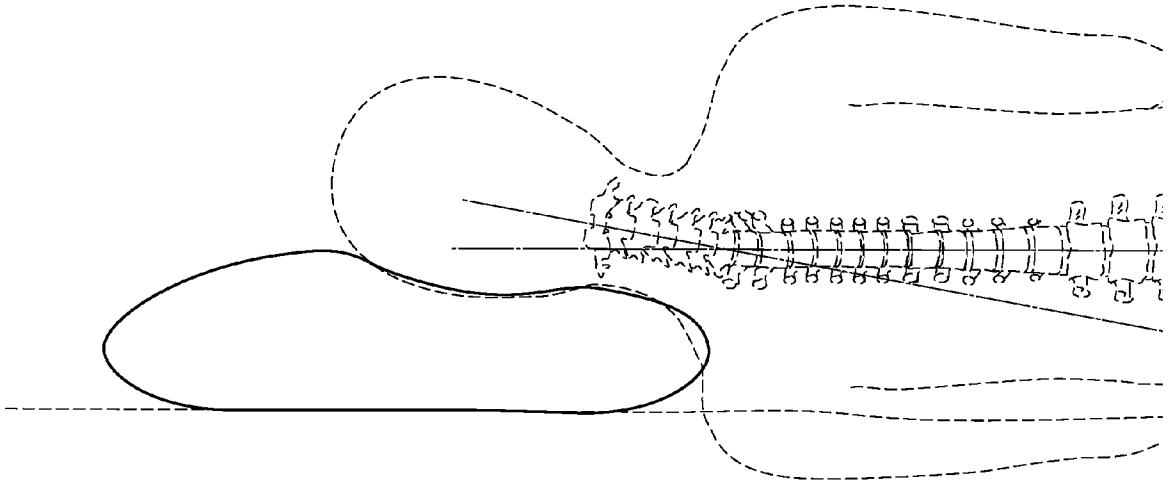
FIG. 5 (PRIOR ART)
FIG. 5 depicts a person sleeping in a side lying position using a prior art pillow with incorrect spinal alignment.
Figure 6:
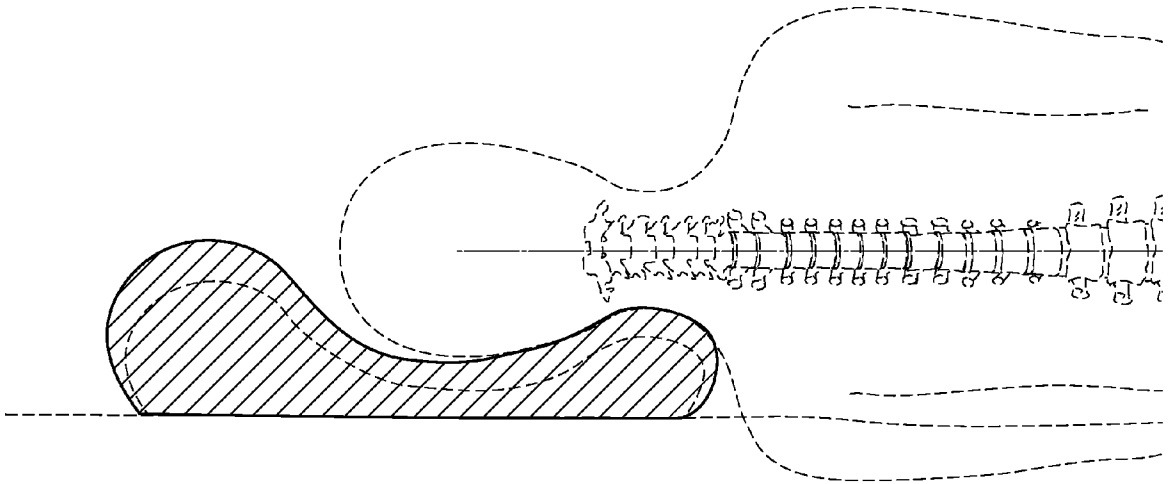
FIG. 6 depicts a person sleeping in a side lying position using an implementation of the present invention allowing for proper spinal alignment.

FIG. 5 and FIG. 6 depict a person lying in the side position. In FIG. 5, the person is resting on a typical prior art pillow. The spine is shown in poor alignment. In FIG. 6, the person is resting on either the right or left compartment of the adjustable cervical contour pillow. FIG. 6 depicts correct spinal alignment after proper adjustment of the heights of the curvatures and web of the pillow.

Figure 7:
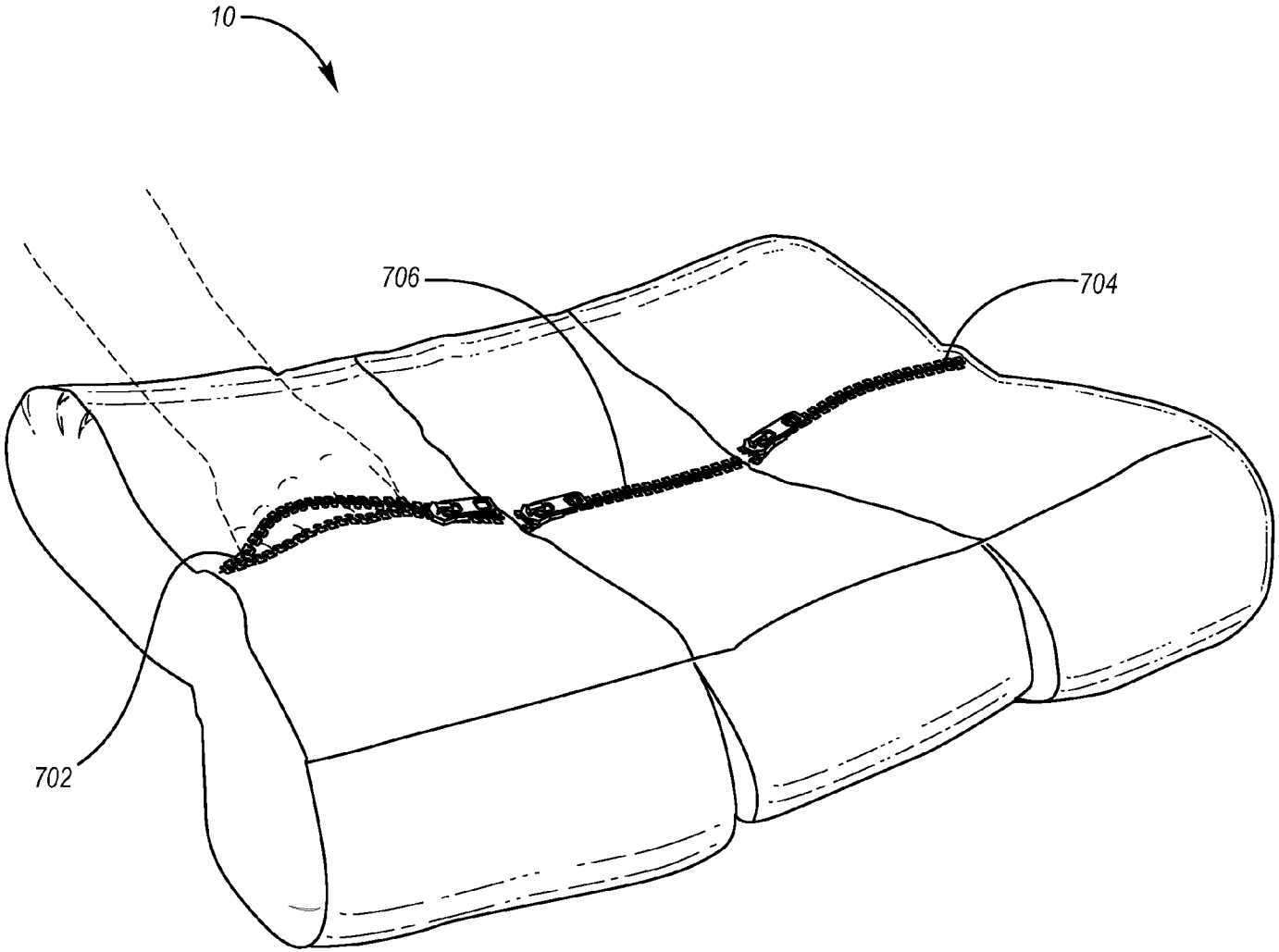
FIG. 7 depicts a posterior view of an implementation of the adjustable cervical contour pillow. A person's hand is shown adding or removing fill using the zipper provided to properly adjust this implementation.

FIG. 7 depicts a posterior view of one embodiment of the adjustable cervical contour pillow 10. In one embodiment, each compartment 102, 104, and 106 is fitted with a separate mechanical closure 702, 704, and 706, however some embodiments may comprise a single mechanical closure that spans more than one compartment. In one embodiment, the mechanical closure 702, 704, and 706 may be a transverse zipper on the posterior face to adjust the amount of internal fill for customization of the pillow 10. Other examples of mechanical closures may include, but are not limited to snaps, buttons, hook and loop closures, hook and eye closures, etc. The pillow 10 is customizable by moving the fill within each of the three compartments of the pillow allowing optimal fit and correct orthopedic posture. Further, fill material may be added or removed to customize the heights of the curvatures 108, 110, 112, 114, 116, and 118 or webs 120, 122, and 124 of the pillow 10 in addition to simply moving the material within each compartment 102, 104, and 106.

Figure 8:
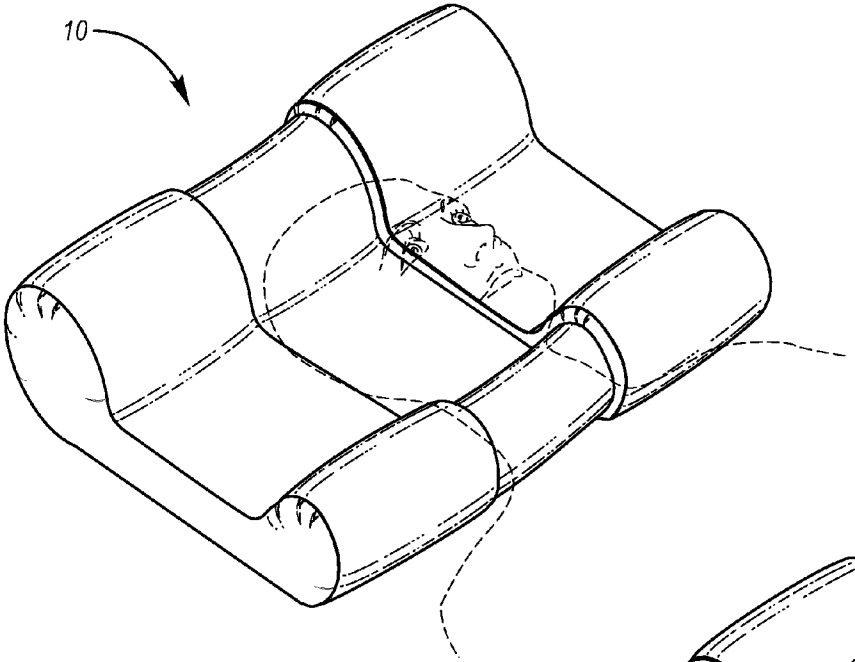
FIG. 8 depicts a perspective view of a person sleeping in a supine lying position using an implementation of the present invention allowing for proper spinal alignment.

In FIG. 8, the person is resting on the center compartment of the adjustable cervical contour pillow 10.

Figure 9:
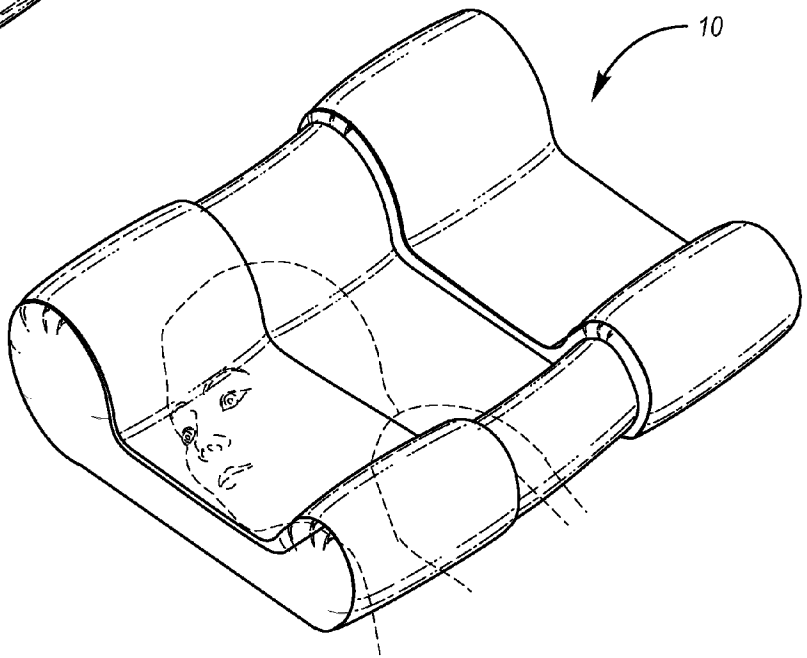
FIG. 9 depicts a perspective view of a person sleeping in a side lying position using an implementation of the present invention allowing for proper spinal alignment.

In FIG. 9, the person is resting on either the left compartment of the adjustable cervical contour pillow 10.

Figure 10:
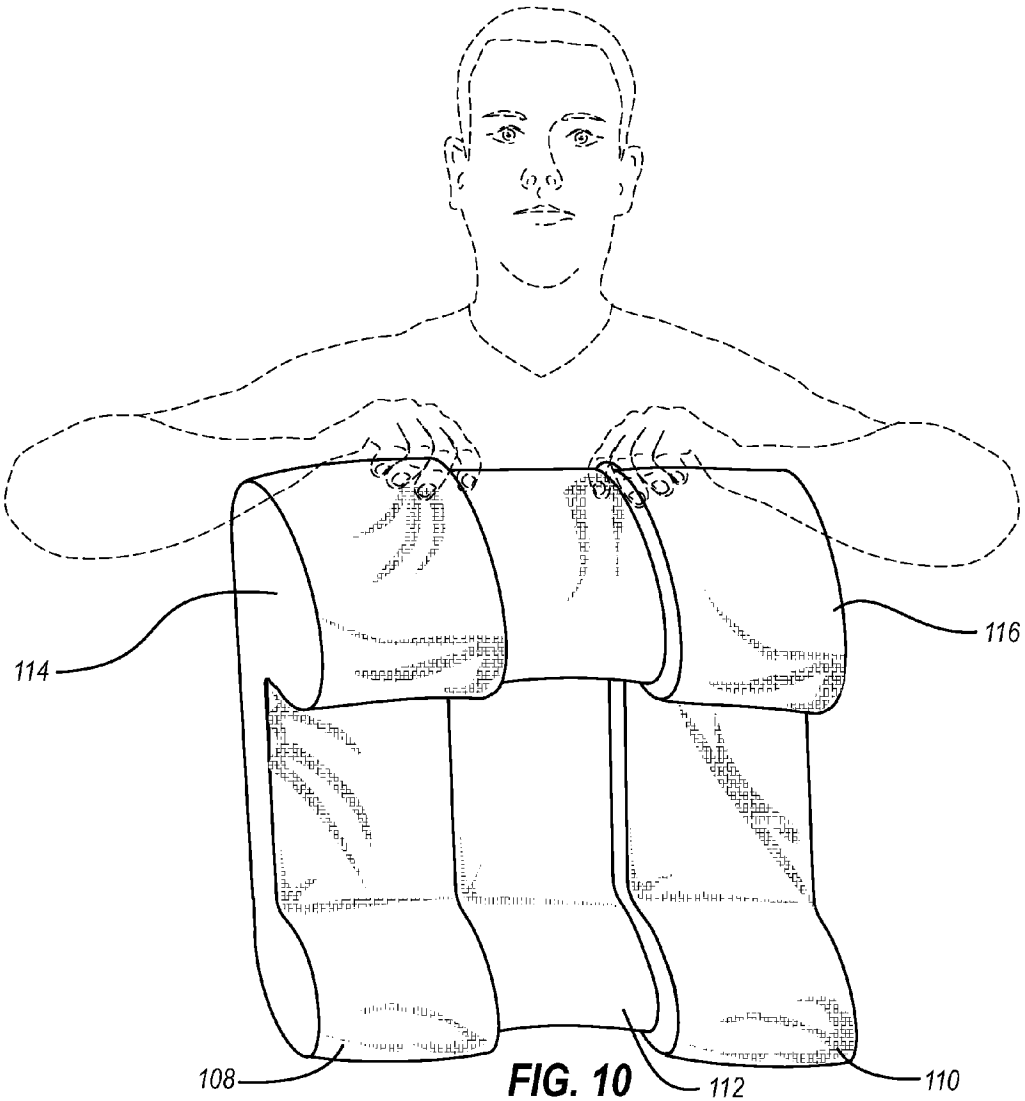
FIG. 10 depicts a person shaking the pillow to adjust the amount of fill in the curvatures allowing for adjustment of the heights of the curvatures in accordance with an embodiment of the present invention.

FIG. 10 depicts a person shaking the pillow 10 to adjust the amount of fill in the curvatures 108, 110, 112, 114, 116, and 118 allowing for adjustment of the heights 202, 204, and 206 of the curvatures 108, 110, 112, 114, 116, and 118 and webs 120, 122 and 124.

The pillow 10 is configured such that the heights of the first curvatures 108, 110 and 112 are less than the heights 202, 204, and 206 of the second curvatures 114, 116, and 118. This is to allow the pillow 10 to be used for a person of a small to medium stature resting with the first curvatures 108, 110 and 112 under the neck. A person with a medium to large stature may turn the pillow around such that the neck rests on the second curvatures 114, 116, and 118, which are larger. In this manner, the pillow 10 is adjustable for people of a wide variety of statures. To adjust the pillow, a person first selects resting on the first 108, 110 and 112 or second curvatures 114, 116, and 118. If the first curvatures 108, 110 and 112 are to be used, sufficient fill is placed into each curvature 108, 110 and 112 and each web 120, 122 and 124, either by shaking as shown in FIG. 10, or by hand as shown in FIG. 7. The proper amount of fill is determined by checking the alignment of the spine in the supine, right side and left side lying positions seen in FIG. 4 and in FIG. 6 respectfully. Similarly, if the second curvatures 114, 116, and 118 are to be used, sufficient fill is placed into each curvature 114, 116, and 118 and each web 120, 122 and 124, either by shaking as shown in FIG. 10, or by hand as shown in FIG. 7. The proper amount of fill is determined by checking the alignment of the spine in the supine, right side and left side lying positions seen in FIG. 4 and in FIG. 6 respectfully.

I claim:

1. An adjustable cervical contour pillow comprising:

a first compartment;

a second compartment; and an intermediate compartment coupled between the first compartment and the second compartment;

wherein each of the first, the second and the intermediate compartments comprise:

a mechanical closure configured to receive and store varying amounts of loose moldable and compressible fill material;

a bottom surface, a first curvature, a second curvature and a web coupled between the first curvature and the second curvature;

wherein:

a height of the first and the second curvatures is greater than a height of the web coupled between them, and the height of the first curvature is greater than the height of the second curvature;

the height of the first and second curvature and web coupling the first and second curvatures of the first and second compartments is greater than a corresponding height of the curvatures and web of the intermediate compartment;

at least half of a length of the webs of the first, the second and the intermediate compartments being substantially flat and parallel to the bottom surfaces of the respective compartments; and the compartments being fluidly independent such that loose fill material placed in a given compartment cannot travel to the other compartments.

2. The adjustable cervical contour pillow of claim 1, wherein a filled height of the first curvatures of the first and second compartments is between 6.0 and 6.5 inches.

3. The adjustable cervical contour pillow of claim 1, wherein a filled height of the second curvatures of the first and second compartments is between 6.5 and 7.0 inches.

4. The adjustable cervical contour pillow of claim 1, wherein a filled height of the web of the first and second compartments is between 5.25 and 5.75 inches.

5. The adjustable cervical contour pillow of claim 1, wherein a filled height of the first curvature of the intermediate compartment is between 5.25 and 4.75 inches.

6. The adjustable cervical contour pillow of claim 1, wherein a filled height of the second curvature of the intermediate compartment is between 6 and 5.5 inches.

7. The adjustable cervical contour pillow of claim 1, wherein a filled height of the web of the intermediate compartment is between 1.25 and 0.75 inches.

8. The adjustable cervical contour pillow of claim 1, wherein the moldable and compressible fill material is shredded latex.

9. The adjustable cervical contour pillow of claim 1, wherein the compartments are covered with a material that is comprised of a bamboo-cotton linen.

10. The adjustable cervical contour pillow of claim 1, wherein at least one compartment is filled with loose moldable and compressible material that is a different material than the material used in the other compartments.

11. The adjustable cervical contour pillow of claim 1, where each compartment is filled with a different loose moldable and compressible material.

12. The adjustable cervical contour pillow of claim 1, wherein the first curvature, the second curvature and the web of each compartment further comprise a mechanical closure configured to receive and store varying amounts of loose moldable and compressible fill material.

13. The adjustable cervical contour pillow of claim 12, wherein the first curvature, the second curvature, and the web of each compartment are fluidly independent such that loose fill material placed in a given curvature or web cannot travel to another curvature or web.

14. An adjustable cervical contour pillow comprising:

a first compartment, a second compartment and an intermediate compartment coupled between the first and second compartments;

each compartment comprising a bottom surface, a first curvature, a second curvature and a flat portion coupled between the first curvature and the second curvature, the flat portion being substantially parallel to the bottom surface;

each first curvature, second curvature and flat portion comprising a minimum height and a maximum height;

wherein:

the minimum height of the first curvature in a given compartment being greater than the maximum height of the flat portion in that compartment;

the minimum height of the second curvature in a given compartment being greater than the maximum height of the first curvature; the minimum heights of the curvatures and flat portions in the first and second compartments being greater than the maximum height of the respective curvatures and flat portion in the intermediate compartment; and a closable aperture configured to receive and store varying amounts of loose moldable and compressible fill material in a given compartment, the compartments being fluidly independent and configured to prevent fill material from traveling between compartments.

15. The adjustable cervical contour pillow of claim 14, wherein at least one compartment is filled with loose moldable and compressible material that is a different material than the material used in the other compartments.

16. The adjustable cervical contour pillow of claim 14, wherein each compartment is filled with a different loose moldable and compressible material.

17. The adjustable cervical contour pillow of claim 14, wherein the first compartment, the second compartment, and the intermediate compartment each further comprise a closable aperture configured to receive and store varying amounts of loose moldable and compressible fill material.

18. The adjustable cervical contour pillow of claim 14, wherein the first curvature, the second curvature and the flat portion of each compartment further comprise a mechanical closure configured to receive and store varying amounts of loose moldable and compressible fill material.

19. The adjustable cervical contour pillow of claim 14, wherein the first curvature, the second curvature, and the flat portion of each compartment are fluidly independent such that loose fill material placed in a given curvature or web cannot travel to another curvature or web.

* * * * *